US007307591B2

(12) United States Patent
Zheng

(10) Patent No.: US 7,307,591 B2
(45) Date of Patent: Dec. 11, 2007

(54) MULTI-BAND ANTENNA

(75) Inventor: Ming Zheng, Farnborough (GB)

(73) Assignee: Nokia Corporation, Espoo (FI)

( * ) Notice: Subject to any disclaimer, the term of this patent is extended or adjusted under 35 U.S.C. 154(b) by 0 days.

(21) Appl. No.: 10/896,212

(22) Filed: Jul. 20, 2004

(65) Prior Publication Data

US 2006/0017635 A1 Jan. 26, 2006

(51) Int. Cl.
*H01Q 1/24* (2006.01)
*H01Q 9/00* (2006.01)
*H01Q 7/00* (2006.01)

(52) U.S. Cl. ..... 343/702; 343/745; 343/748

(58) Field of Classification Search ..... 343/745, 343/749, 750, 700 MS, 748, 702
See application file for complete search history.

(56) References Cited

U.S. PATENT DOCUMENTS

| | | | | |
|---|---|---|---|---|
| 6,597,318 | B1 * | 7/2003 | Parsche et al. | 343/700 MS |
| 6,624,788 | B2 * | 9/2003 | Boyle | 343/702 |
| 6,853,341 | B1 * | 2/2005 | Hellgren et al. | 343/742 |
| 2002/0180650 | A1 * | 12/2002 | Pankinaho et al. | 343/702 |
| 2004/0125027 | A1 * | 7/2004 | Rubinshteyn et al. | 343/702 |
| 2004/0252061 | A1 * | 12/2004 | Vance | 343/702 |

FOREIGN PATENT DOCUMENTS

| | | |
|---|---|---|
| GB | 2 291 271 A | 1/1996 |
| JP | 2002 269724 | 9/2000 |
| WO | WO 97/47054 | 12/1997 |
| WO | WO 99/13528 | 3/1999 |
| WO | WO 2004/001898 A1 | 12/2003 |

OTHER PUBLICATIONS

Almeida et al, The AARL Antenna Book, The American Radio Relay League, pp. 2-24 and 2-25.*
Zheng, M. et al., "Low-profile WCDMA Internal Antenna".
Kitchener, D. et al., "Low Cost Diversity Antennas for Low Power Wireless Basestations", Apr. 14-17, 1997, 10th International Conference on Antennas and Propagation, Conference Publication No. 436, pp. 1445-1447.
Lee, E. et al., "Dual band folded monopole/loop antenna for terrestrial communication system", Nov. 23, 2000, Electronics Letters, vol. 36, No. 24, pp. 1990-1991.
Yang, F. et al., "Wide-Band E-Shaped patch Antennas for Wireless Communications", Jul. 2001, IEEE Transactions on Antennas and Propagation, vol. 49, No. 7, pp. 1094-1100.
Flint, J.A. et al., "Exploitation of Nonradiating Modes in Asymmetric Coplanar Strip Folded Dipoles", Jun. 14, 2004, IEEE Proceedings, vol. 151, No. 4, pp. 307-310.
Katsibas, K.D. et al., "Folded Loop Antenna for Mobile Hand-Held Units", Feb. 2, 1998, IEEE Inc., vol. 46, No. 2, 7 pgs.

* cited by examiner

*Primary Examiner*—Don Wong
*Assistant Examiner*—Angela M Lie
(74) *Attorney, Agent, or Firm*—Harrington & Smith, PC

(57) ABSTRACT

An antenna having a plurality of resonant frequencies and comprising a feed point, a ground point and a conductive track that extends from the feed point and returns to the ground point and means for locally increasing the reactance of the antenna track at a first position coincident with a maximum electromagnetic field associated with at least one of the plurality of resonant frequencies.

31 Claims, 4 Drawing Sheets

MULTI-BAND ANTENNA

FIELD OF THE INVENTION

Embodiments of the invention relate to multi-band antennas. One embodiment relates to a planar antenna that is suitable for use as an internal antenna in a cellular radio communication terminal.

BACKGROUND TO THE INVENTION

A current internal antenna used as an internal antenna in cellular mobile telephones is the Planar Inverted-F antenna (PIFA). This type of antenna comprises an antenna element 12 that is parallel to a ground plane that connects the ground point and feed point together towards one end of the antenna element. These antennas suffer from a number of disadvantages. They have at most two operational resonant frequencies which could be used at the cellular bands. The separation between the antenna element and the ground plate needs to be kept fairly large (~7 mm) in order to maintain a satisfactory bandwidth.

It would be desirable to provide a more compact antenna particularly one with a low profile.

It would be desirable to provide an antenna with three operational resonant frequencies, which could be used at the cellular bands

BRIEF DESCRIPTION OF THE INVENTION

According to one aspect of the invention there is provided an antenna having a plurality of resonant frequencies and comprising a feed point, a ground point and a conductive track that extends from the feed point and returns to the ground point and means for locally increasing the reactance of the antenna track at a first position coincident with a maximum electromagnetic field associated with at least one of the plurality of resonant frequencies.

According to another aspect of the invention there is provided an antenna having a plurality of resonant frequencies and comprising a feed point, a ground point and a conductive track that extends from the feed point and returns to the ground point and further comprising means for locally raising the capacitance of the antenna track at a first position coincident with a maximum electric field (E field) associated with at least one of the plurality of resonant frequencies.

According to another aspect of the invention there is provided an antenna having a plurality of resonant frequencies and comprising a feed point, a ground point and a conductive track that extends from the feed point and returns to the ground point and further comprising means for locally raising the inductances of the antenna track at positions coincident with maximum magnetic field (H fields) associated with at least one of the plurality of resonant frequencies.

According to another aspect of the invention there is provided an antenna having a plurality of resonant frequencies and comprising a feed point, a ground point and a conductive track that extends from the feed point and returns to the ground point and further comprising means for locally raising the inductance of the antenna track at positions ¼ and ¾ way along the conductive track.

According to another aspect of the invention there is provided an antenna having a plurality of resonant frequencies and comprising a feed point, a ground point and a conductive track that extends from the feed point and returns to the ground point and further comprising means for locally raising the capacitance of the antenna track at a position half way along the conductive track.

Embodiments of the invention advantageously use a loop-like antenna as a folded monopole, folded dipole antenna.

BRIEF DESCRIPTION OF THE DRAWINGS

For a better understanding of the present invention reference will now be made by way of example only to the accompanying drawings in which.

DETAILED DESCRIPTION OF THE INVENTION

The FIGS. 1A, 1B, 4 and 5 illustrate antennas having a plurality of resonant frequencies and comprising a feed point, a ground point and a conductive track that extends from the feed point and returns to the ground point and means for locally increasing the reactance of the antenna track at a first position coincident with a maximum electromagnetic field associated with at least one of the plurality of resonant frequencies. The capacitance may be locally increased where the E field is maximum and/or the inductance may be locally increased where the H field is maximum.

Figure 1A:
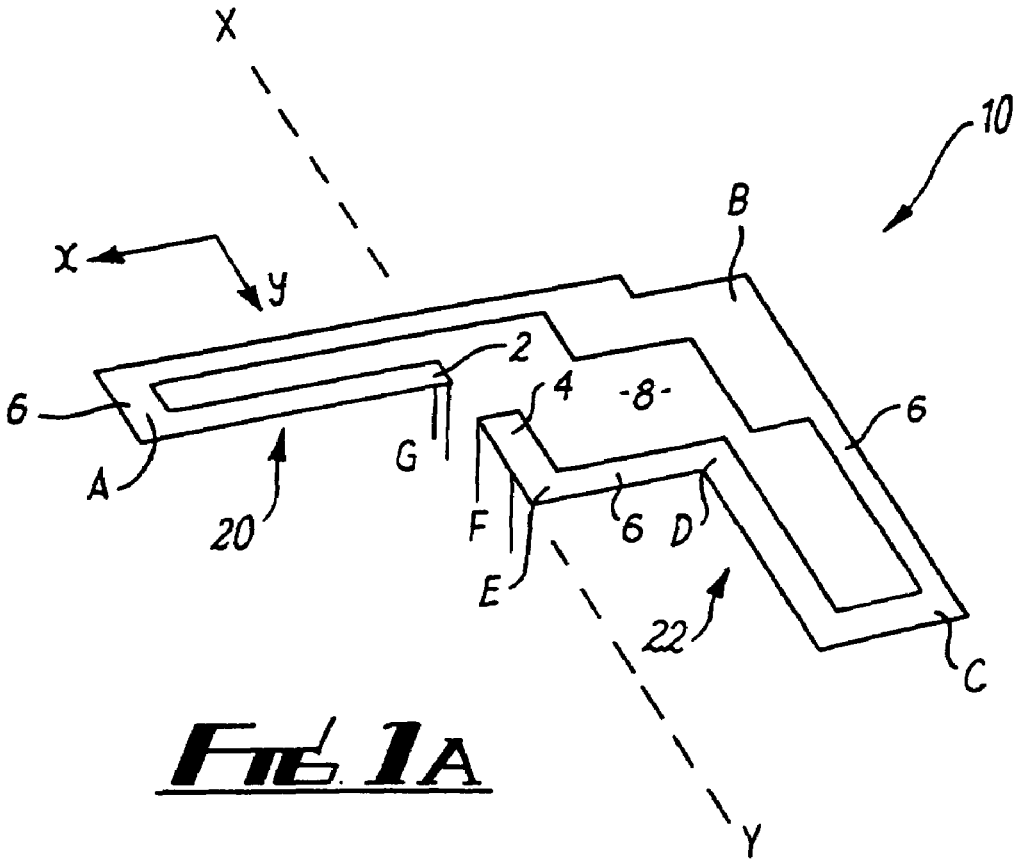
FIGS. 1A and 1B illustrate a planar multi-band antenna.
Figure 1B:
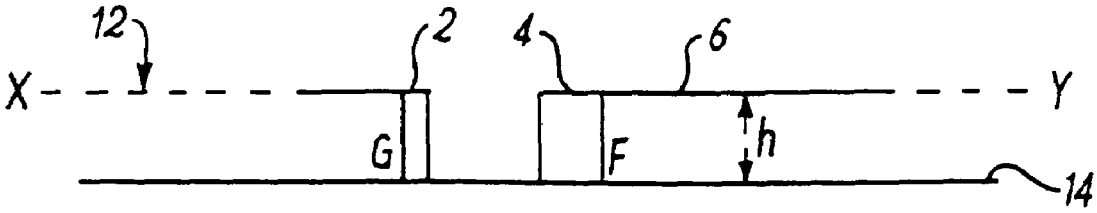

FIGS. 1A and 1B illustrate a planar multi-band antenna 10. The antenna is a planar folded monopole, folded dipole antenna and has a plurality of operational resonant frequencies. The particular antenna illustrated has three resonances that respectively cover the two EGSM bands (850, 900 MHz), the PCN band (1800 MHz) and the PCS band (1900 MHz). The antenna 10 is particularly suited for use as an internal antenna of a mobile cellular radio terminal, such as a mobile telephone, as it has a low profile structure.

The antenna 10 is loop-like having a single ground point 2 adjacent a single feed point 4 and a single antenna track 6 that extends from the ground point 2 to the feed point 4 in a single loop-like structure.

The structure is non-circular and encloses a non-regular area of space 8. The track has a number of substantially acute angled bends (≦90 degrees) and lies in a flat geometric plane 12, which is parallel to the ground plane 14. The separation h between the track 6 and ground plane 14 can be made of the order of a few millimetres, which results in an advantageously low profile antenna 10.

A co-ordinate system 30 is included in FIG. 1A. This system 30 comprises an x vector that is orthogonal to a y vector. The feed point 4 is displaced from the ground point in a +y direction.

The single track 6 extends away from the ground point in an +x direction, makes two right angled right bends in quick succession at point A and returns in a −x direction past the feed point to point B. This return of track forms a first arm 20.

The track extends away from point B in an +y direction past the ground point 2 and feed point 4 but parallel to an imaginary line X-Y drawn between them, and makes two right angled right bends in quick succession at point C and returns in a −y direction to the feed point 4. This return of track forms a second arm 22. In this example, the second arm 22 is staggered as the track 6, before it reaches the feed point 4, makes a right angled left bend at point D, extends in the +x direction and then makes a right angled right bend at point E and extends in the −y direction to the feed point 4. The bends in the track 6 lie in the single geometric plane 12.

The first arm 20 and second arm 22 therefore extend orthogonally to each other but occupy the same geometric plane. However, the antenna is asymmetric as the first and second arms have a different shape because of the turns at points D and E.

The antenna track 10 has a substantially constant width except in the vicinity of the point B where the first and second arms join. The antenna track 10 is capacitively loaded in the vicinity of point B. This is achieved by increasing the width of the antenna track significantly in this area. This loading increases the capacitive coupling between the track 10 at this point and the ground plane 14.

It may be possible to use other forms of capacitive loading such as bringing the track in the vicinity of point B closer to the ground plane or providing a dielectric with increased electrical permittivity between the track 6 in the vicinity of point B and the ground plane 14. However, one of the most convenient ways to capacitively load the track 6 is by increasing its area by increasing the track width.

A folded dipole may be defined as two parallel λ/2 dipoles connected at their four open ends. If the length of the track 6 from ground point 2 to feed point 4 is L, then the resonant modes of a folded dipole may be represented by: $L=n_d*\lambda$, where $n_d$ is a whole number representing a resonant folded dipole mode and λ is a electromagnetic wavelength of the resonant frequency for that mode. When $n_d=0$, the resonant mode dipole mode doesn't exist.

A folded monopole may be defined as two parallel λ/4 monopoles connected at their two open ends. The resonant modes of a folded monopole may be represented by: $L=(2n_m+1)*\lambda/2$, where $n_m$ is a whole number representing a resonant folded monopole mode and λ is a electromagnetic wavelength of the resonant frequency for that mode.

The position ($y_d$) from the ground point of maximum electric field (Emax) for a folded dipole may be given by: $y_d=(2*a_d-1)/n_d*(L/4)$ where $a_d=1, \ldots, 2n_d$. However, in practice, the position of maximum E field may deviate slightly from the formula because of applied reactive loading.

The position ($y_m$) from the ground point of maximum electric field (Emax) for a folded monopole may be given by: $y_m=(2*a_m-1)/(2n_m+1)*L/2$ where $a_m=1, \ldots, 2n_m+1$. However, in practice, the position maximum E field may deviate slightly from the formula because of applied reactive loading.

The table below sets out the lower 5 modes of the folded monopole, folded dipole antenna and the maximum E field positions. Each mode may be conveniently referred to as ($n_d$, $n_m$). The wavelength corresponding to the resonant frequency of a mode ($n_d$, $n_m$) may be conveniently referred to using $\lambda_{nd\ nm}$.

It should be noted, that for modes where $n_d>0$ and $n_m=0$, the position of Max E field is given by $y_d$ and not $y_m$. It should be noted, that for modes where $n_d=0$, the position of Max E field is given by $y_m$ and not $y_d$.

| $n_d$ | $n_m$ | $\lambda_{nd\ nm}$ | Frequency | Max E field position |
|---|---|---|---|---|
| 0 | 0 | 2L | ½ * 1/L * c | L/2 |
| 1 | 0 | L | 1/L * c | L/4, 3L/4 |
| 0 | 1 | 2L/3 | 3/2 * 1/L * c | L/6 L/2 5L/6 |
| 2 | 0 | L/2 | 2 * 1/L * c | L/8, 3L/8, 5L/8, 7L/8 |
| 0 | 2 | 2L/5 | 5/2 * 1 * /L * c | L/10, 3L/10, L/2, 7L/10, 9L/10 |
| . | . | . | . | . |

c: velocity of electromagnetic wave

In the (0,0) mode the antenna operates as two λ/4 monopole structures connected at the max E field position L/2. $\lambda_{00}$ corresponds to 2L.

In the (1, 0) mode the antenna operates as two λ/2 dipole structures which are connected in parallel at positions coincident with the maximum E field positions L/4 and 3L/4. $\lambda_{10}$ corresponds to L.

In the (0,1) mode the antenna operates in a resonant mode of two λ3/4 monopole structures connected at max E field position L/2. $\lambda_{01}$ corresponds to 2L/3.

Capacitive loading at the position from the ground point of maximum electric field (Emax) for a mode, reduces the resonant frequency of that mode.

Figure 3:
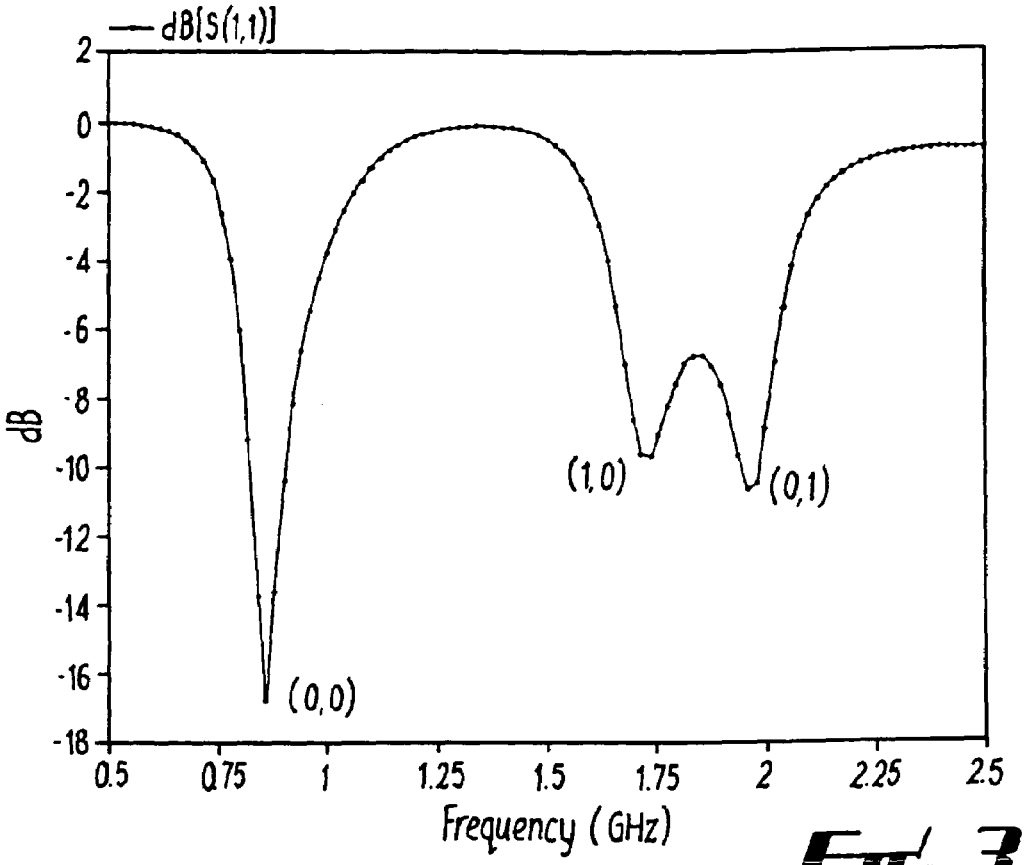
FIG. 3 illustrates the typical return loss of the resonant modes (0,0), (1,0) and (0,1) for a loaded, planar, folded monopole, folded dipole antenna.

The capacitive loading at L/2 of the antenna 10 of FIGS. 1A and 1B reduces the resonant frequency of the folded monopole modes (0,0), (0,1). The resonant modes (0,0), (1,0) and (0,1) for the loaded, planar, folded monopole, folded dipole antenna is illustrated in FIG. 3.

Figure 2A:
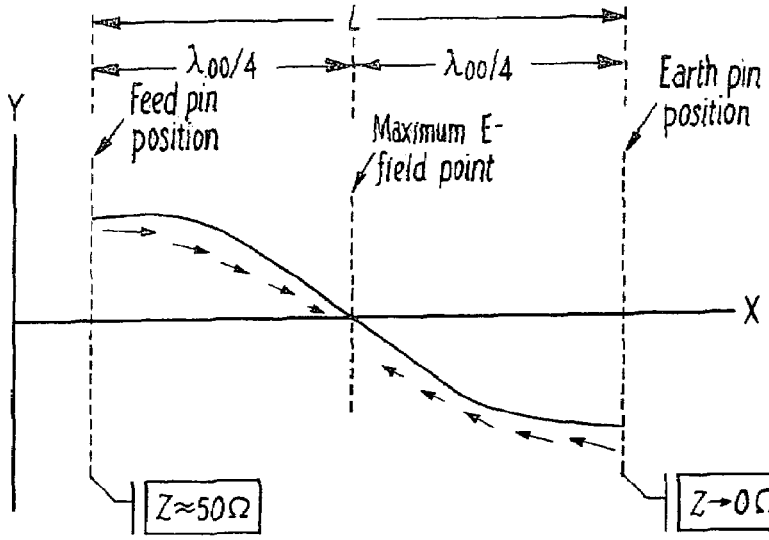
FIGS. 2A, 2B, 2C illustrates simplified vector current distribution for the resonant modes (0,0), (1,0) and (0,1)

Due to the asymmetry of the first and second arms the (0,0) mode has two slightly different resonant frequencies that overlap to form a resonant frequency with a bandwidth that is larger than a single monopole. This large bandwidth is suitable for EGSM (850, 900 MHz). FIG. 2A illustrates a simplified vector current distribution for this mode.

Figure 2B:
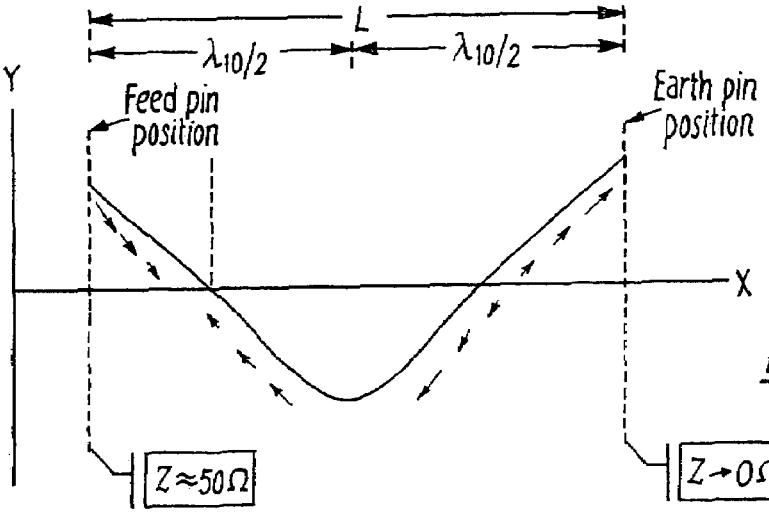

Due to the asymmetry of the first and second arms the (0,0) mode has two slightly different resonant structures, their frequencies overlap to form an antenna with a bandwidth that is larger than a single λ/2 resonant element. This larger bandwidth is suitable for PCN (1800 MHz). FIG. 2B illustrates a simplified vector current distribution for this mode.

Figure 2C:
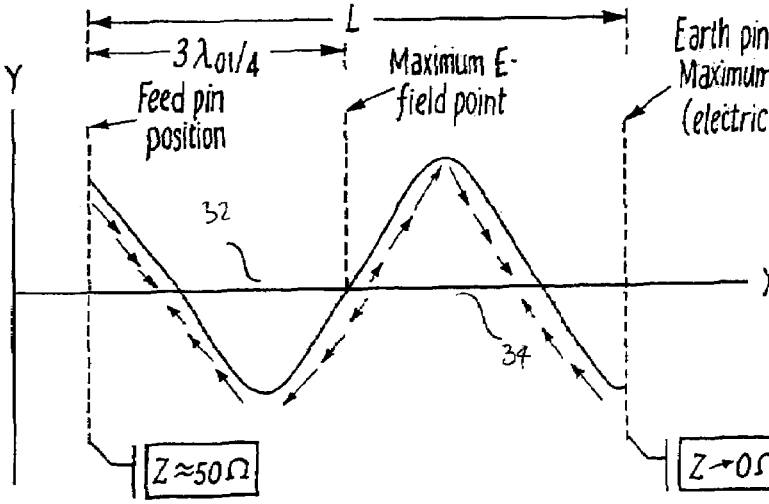

The (0,1) mode is suitable for PCS (1900 MHz). FIG. 2C illustrates a simplified vector current distribution for this mode.

The antenna 10 must of course satisfy some electromagnetic boundary conditions. The electrical impedance at the feed point is close to 50 Ohm and the electrical impedance at the ground point is close to 0 Ohm.

It should be noted that the electromagnetic coupling between the arms ABC and ADC is optimised to obtain an acceptable return loss (e.g. 6 dB) at the cellular bands. The coupling is controlled by varying the distance between the above two arms.

The antenna 10 has advantageously large bandwidths. This enables the distance between the antenna track and ground plane to be reduced, as the bandwidth is sufficiently big to withstand the consequent increase in Q and narrowing of the bandwidth. This makes it very suitable as an internal antenna for hand-portable devices. In addition, the antenna 10 is not sensitive to a ground plane by comparison to a normal PIFA.

Figure 4:
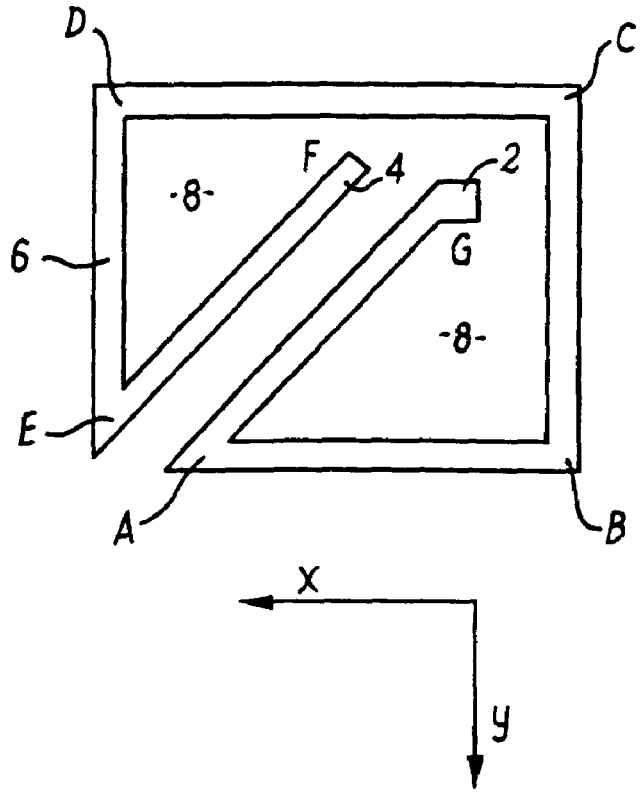
FIG. 4 illustrates another example of a loaded, planar, folded monopole, folded dipole antenna.

FIG. 4 illustrates another example of a loaded, planar, folded monopole, folded dipole antenna 10. The antenna has a plurality of operational resonant frequencies. The particular antenna illustrated has three resonances that respectively cover the two EGSM bands (850, 900 MHz), the PCN band (1800 MHz) and the PCS band (1900 MHz). The antenna 10 is particularly suited for use as an internal antenna of a mobile cellular radio terminal, such as a mobile telephone, as it has a low profile.

The antenna 10 is loop-like having a single ground point 2 adjacent a single feed point 4 and a single antenna track 6 that extends from the ground point 2 to the feed point 4 in a single loop-like structure.

The structure encloses a non-regular area of space 8. The 6 track has a number of substantially acute angled bends (≦90 degrees) and lies in a flat geometric plane 12, which is parallel to the ground plane 14. The separation h between the track 6 and ground plane 14 can be made of the order of a few millimetres, which results in an advantageously low profile antenna 10.

A co-ordinate system 30 is included in FIG. 4. This system 30 comprises an x vector that is orthogonal to a y vector. Directions concerning FIG. 4 will be expressed as a vector [x,y]. The feed point 4 is displaced from the ground point in a +y direction.

The single track 6 extends away from the ground point in a [1,1] direction, makes an acute angled left bend at point A, extends in direction [−1,0] to point B, then makes an acute angled left bend at point B. The track extends in direction [0, −1] to point C where in makes a right angled left bend and extends in direction [1,0] to pint D. At point D, the track makes a right angled left bend and extends in direction [0, 1] to point E, where it makes an acute angled left bend and extends in direction [−1,−1] to the feed point 4.

The antenna track 10 is capacitively loaded in the vicinity of point C at L/2. This is achieved by having the ground point 2 proximal to point C. This loading increases the capacitive coupling between the track 10 at this point and ground.

The structure is asymmetric as the length of track between points A and C is less than the length of track between points E and C.

In the preceding examples, capacitive loading is applied at a point of maximum E field for a mode in order to reduce the resonant frequency of that mode.

It is also alternatively or additionally possible to apply inductive loading at a point (e.g., 32 or 34 in FIG. 2C) of maximum H field for a mode in order to reduce the resonant frequency of that mode. One way of providing inductive loading is to narrow the width of the track.

For a folded monopole, the position of maximum H field may be $L*b_m/(2n_m+1)$, where $b_m=0, \ldots, 2n_m+1$. For a folded dipole, the position of maximum H field may be $L*b_d/2n_d$. where $b_d=0, \ldots, 2n_d$. When $n_d=0$, the dipole mode doesn't exist, therefore the above formula is not applied for $n_d=0$. However, in practice, the position of maximum H field may deviate slightly from the formulae because of applied reactive loading.

The table below sets out the lower 5 modes of the folded monopole, folded dipole antenna and the maximum H field positions. Each mode may be conveniently referred to as ($n_d$, $n_m$). The wavelength corresponding to the resonant frequency of a mode ($n_d$, $n_m$) may be conveniently referred to using $\lambda_{nd\ nm}$.

| $n_d$ | $n_m$ | $\lambda_{nd\ nm}$ | Frequency | Max H field position |
|---|---|---|---|---|
| | 0 | 2L | ½ * 1/L * c | 0, L |
| 1 | | L | 1/L * c | 0, L/2, L |
| | 1 | 2L/3 | 3/2 * 1/L * c | 0, L/3 (ref #32), 2L/3 (ref #34), L |
| 2 | | L/2 | 2 * 1/L * c | 0, L/4, L/2, 3L/4, L |
| 0 | 2 | 2L/5 | 5/2 * 1/L * c | 0, L/5, 2L/5, 3L/5, 4L/5; L |
| . | . | . | . | . |

Figure 5:
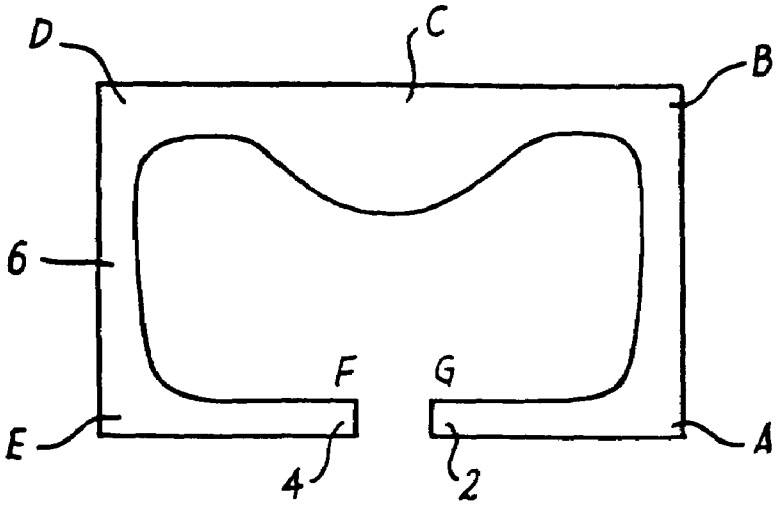
FIG. 5 illustrates another example of a loaded, planar, folded monopole, folded dipole antenna.

FIG. 5 illustrates another example of a loaded, planar, folded monopole, folded dipole antenna 10. In this antenna, the antenna track 6 makes obtuse rather than acute angle bends. The antenna has capacitive loading at point C arising from the increase of antenna track width at this point.

Figure 6:
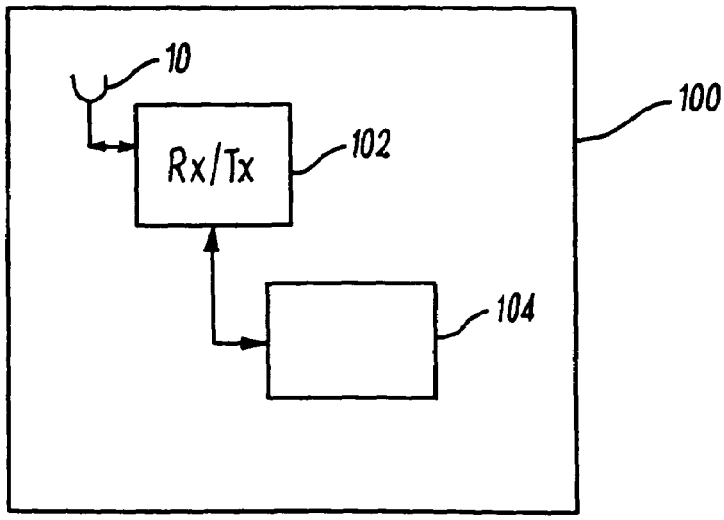
FIG. 6 illustrates a radio transceiver device comprising a loaded, folded monopole, folded dipole antenna.

FIG. 6 illustrates a radio transceiver device 100 such as a mobile cellular telephone, cellular base station, other wireless communication device or module for such a device. The radio transceiver device 100 comprises a planar multi-band antenna 10, as described above, radio transceiver circuitry 102 connected to the feed point of the antenna and functional circuitry 104 connected to the radio transceiver circuitry. In the example of a mobile cellular telephone, the functional circuitry 104 includes a processor, a memory and input/out put devices such as a microphone, a loudspeaker and a display. Typically the electronic components that provide the radio transceiver circuitry 102 and functional circuitry 104 are interconnected via a printed wiring board (PWB). The PWB may be used as the ground plane 14 of the antenna 10 as illustrated in FIG. 1B.

Although embodiments of the present invention have been described in the preceding paragraphs with reference to various examples, it should be appreciated that modifications to the examples given can be made without departing from the spirit and scope of the invention. Although, in the examples illustrated the conductive track lies in a plane parallel to a ground plane, this is not essential to the proper functioning of the antenna and the conductive track may lie in a plane that is not parallel to a ground plane.

The invention claimed is:

1. An antenna having a plurality of resonant frequencies and comprising a feed point, a ground point and a conductive antenna track that extends from the feed point and returns to the ground point to form one of a folded monopole or a folded dipole and an antenna track configuration for locally increasing the reactance of the conductive antenna track at a first position on the conductive antenna track, between the feed point and the ground point;

wherein the antenna track configuration for locally increasing the reactance comprises localized capacitive loading at the first position, wherein the first position is coincident with a maximum E-field associated with at least one of the plurality of resonant frequencies; and wherein the antenna track configuration for locally increasing the reactance comprises localized inductive loading at a third position, wherein the third position is coincident with a maximum H-field associated with at least one of the plurality of resonant frequencies.

2. An antenna as claimed in claim 1, wherein the antenna track configuration for locally increasing reactance comprises localized reactive loading of the antenna track at the first position.

3. An antenna as claimed in claim 1, wherein the antenna track configuration for locally increasing the reactance comprises localized capacitive loading at a second position, wherein the second position is coincident with a maximum E-field associated with at least one of the plurality of resonant frequencies.

4. An antenna as claimed in claim 1, wherein the localized capacitive loading comprises a locally increased conductive antenna track area compared to adjacent portions of the conductive antenna track.

5. An antenna as claimed in claim 1, wherein the localized capacitive loading arises from the location of the ground point adjacent but separated from the first position.

6. An antenna as claimed in claim 1, wherein the conductive antenna track has a plurality of bends including at least one bend at the first position.

7. An antenna as claimed in claim 6, wherein the at least one bend is an acute angled bend.

8. An antenna as claimed in claim 1, wherein the first position is half way along the length of the conductive antenna track.

9. An antenna as claimed in claim 1 wherein the conductive antenna track lies in a single plane parallel to a ground plane.

10. An antenna as claimed in claim 1 wherein the conductive antenna track lies in a single plane not parallel to a ground plane.

11. An antenna as claimed in claim 1, wherein the conductive antenna track has a plurality of acute bends.

12. An antenna as claimed in claim 1 wherein the conductive antenna track forms two arms that extend from a point of mutual contact in orthogonal directions.

13. An antenna as claimed in claim 1 used as an internal antenna of a cellular radio communications terminal.

14. A transceiver device comprising an antenna as claimed in claim 1.

15. An antenna as claimed in claim 1, wherein the antenna track configuration is permanent.

16. An antenna as claimed in claim 1, further comprising a ground plane and a dielectric material permanently disposed between the first position and the ground plane.

17. An antenna having a plurality of resonant frequencies and comprising a feed point, a ground point and a conductive antenna track that extends from the feed point and returns to the ground point to form one of a folded monopole or a folded dipole and an antenna track configuration for locally increasing the reactance of the conductive antenna track at a first position on the conductive antenna track, between the feed point and the ground point;

wherein the antenna track configuration for locally increasing the reactance comprises localized capacitive loading at the first position, wherein the first position is coincident with a maximum E-field associated with at least one of the plurality of resonant frequencies, and wherein the first position is $(2*a_d-1)/4*n_d$ along the length of the conductive antenna track, where $a_d$ is equal to one of $1, \ldots, 2n_d$ and $n_d$ is a natural number.

18. An antenna having a plurality of resonant frequencies and comprising a feed point, a ground point and a conductive antenna track that extends from the feed point and returns to the ground point to form one of a folded monopole or a folded dipole and an antenna track configuration for locally increasing the reactance of the conductive antenna track at a first position on the conductive antenna track, between the feed point and the ground point;

wherein the antenna track configuration for locally increasing the reactance comprises localized capacitive loading at the first position, wherein the first position is coincident with a maximum E-field associated with at least one of the plurality of resonant frequencies, and wherein the first position is $(2*a_m-1)/((2n_m+1)*2)$ along the length of the conductive antenna track, where $a_m$ is equal to one of $1, \ldots, 2n_m+1$ and $n_m$ is a whole number.

19. An antenna having a plurality of resonant frequencies and comprising a feed point, a ground point and a conductive antenna track that extends from the feed point and returns to the ground point to form one of a folded monopole or a folded dipole and an antenna track configuration for locally increasing the reactance of the conductive antenna track at a first position on the conductive antenna track, between the feed point and the ground point, wherein the antenna track configuration for locally increasing the reactance comprises localized inductive loading at the first position, wherein the first position is coincident with a maximum H-field associated with at least one of the plurality of resonant frequencies, and wherein the first position is $b_d/2n_d$ along the length of the conductive antenna track where $b_d$ is equal to one of $0, \ldots, 2n_d$ and $n_d$ is a natural number.

20. An antenna as claimed in claim 19, wherein the localized inductive loading comprises a locally decreased conductive antenna track area compared to adjacent portions of the conductive antenna track.

21. An antenna having a plurality of resonant frequencies and comprising a feed point, a ground point and a conductive antenna track that extends from the feed point and returns to the ground point to form one of a folded monopole or a folded dipole and an antenna track configuration for locally increasing the reactance of the conductive antenna track at a first position on the conductive antenna track, between the feed point and the ground point, wherein the antenna track configuration for locally increasing the reactance comprises localized inductive loading at the first position, wherein the first position is coincident with a maximum H-field associated with at least one of the plurality of resonant frequencies, and wherein the first position is $b_m/(2n_m+1)$ along the length of the conductive antenna track where $b_m$ is equal to one of $0, \ldots, 2n_m+1$ and $n_m$ is a whole number.

22. An antenna as claimed in claim 21, wherein the antenna track configuration for locally increasing the reactance comprises localized inductive loading at a second position, wherein the second position is coincident with a maximum H-field associated with at least one of the plurality of resonant frequencies.

23. An antenna having a plurality of resonant frequencies and comprising a feed point, a ground point and a conductive antenna track that extends from the feed point and returns to the ground point to form one of a folded monopole or a folded dipole and further comprising an antenna track configuration for locally raising the capacitance of the conductive antenna track at a first position on the conductive antenna track, between the feed point and the ground point, coincident with a maximum electric field associated with at least one of the plurality of resonant frequencies, wherein the first position is $(2*a_d-1)/4*n_d$ along the length of the conductive track where $a_d=1, \ldots, 2n_d$ and $n_d$ is a natural number.

24. An antenna having a plurality of resonant frequencies and comprising a feed point, a ground point and a conductive antenna track that extends from the feed point and returns to the ground point to form one of a folded monopole or a folded dipole and further comprising an antenna track configuration for locally raising the capacitance of the conductive antenna track at a first position on the conductive antenna track, between the feed point and the ground point, coincident with a maximum electric field associated with at least one of the plurality of resonant frequencies, wherein the first position is $(2*a_m-1)/(2n_m+1)$ along the length of the conductive antenna track where $a_m=1, \ldots, 2n_m-1$ and $n_m$ is a whole number.

25. An antenna having a plurality of resonant frequencies and comprising a feed point, a ground point and a conductive track that extends from the feed point and returns to the ground point and further comprising an antenna track configuration for locally raising the inductance of the antenna track at positions ⅓ and ⅔ way along the conductive track.

26. An antenna having a plurality of resonant frequencies and comprising a feed point, a ground point and a conductive antenna track that extends from the feed point and returns to the ground point to form one of a folded monopole or a folded dipole and further comprising an antenna track configuration for locally raising the capacitance of the antenna track at a position half way along the conductive antenna track between the feed point and the ground point, wherein the antenna track configuration comprises an acute angled bend at the position half way along the conductive antenna track.

27. An antenna as claimed in claim 26, wherein the antenna track configuration is permanent.

28. An antenna as claimed in claim 26, further comprising a ground plane and a dielectric material permanently disposed between the first position and the ground plane.

29. An antenna having a plurality of resonant frequencies and comprising:

a feed point;

a ground point; and a conductive antenna track that extends from the feed point and returns to the ground point to form one of a folded monopole or a folded dipole and an antenna track arrangement for locally and permanently increasing the reactance of the conductive antenna track at a first position on the conductive antenna track, between the feed point and the ground point, coincident with a maximum electromagnetic field associated with at least one of the plurality of resonant frequencies, wherein the antenna track configuration comprises an acute angled bend at the first position.

30. An antenna as claimed in claim 29, wherein the antenna track arrangement comprises a permanent configuration of the conductive antenna track.

31. An antenna as claimed in claim 29, wherein the antenna track arrangement comprises a dielectric material disposed between the first position and a ground plane that is resonant with the antenna at one or more of the plurality of resonant frequencies.

* * * * *